US007047566B2

(12) United States Patent
Béland et al.

(10) Patent No.: US 7,047,566 B2
(45) Date of Patent: May 23, 2006

(54) LEG PAD WITH A STRAP

(75) Inventors: Jean-François Béland, Montreal (CA); Dominique Plante, Montreal (CA)

(73) Assignee: Bauer Nike Hockey Inc., St-Jèrôme (CA)

( * ) Notice: Subject to any disclaimer, the term of this patent is extended or adjusted under 35 U.S.C. 154(b) by 306 days.

(21) Appl. No.: 10/722,470

(22) Filed: Nov. 28, 2003

(65) Prior Publication Data

US 2005/0114976 A1 Jun. 2, 2005

(51) Int. Cl.
*A41D 13/00* (2006.01)

(52) U.S. Cl. ..... 2/22

(58) Field of Classification Search ..... 2/22, 2/24, 16, 62, 311, 338, 908, 911, 919, 920, 2/312, 321, 322, 326; 602/23, 26, 62; 128/878, 128/882

See application file for complete search history.

(56) References Cited

U.S. PATENT DOCUMENTS 4,497,070 A * 2/1985 Cho ..... 2/22
5,405,312 A * 4/1995 Jacobs ..... 602/5
5,829,055 A * 11/1998 Collins et al. ..... 2/22
6,226,796 B1 * 5/2001 Tollini ..... 2/22

OTHER PUBLICATIONS

Nike 2003 Hockey Catalogue; (Front page, pp. 11 & 12).

* cited by examiner

*Primary Examiner*—Tejash Patel

(57) ABSTRACT

The present invention provides a leg pad comprising a shin guard and a strap. The strap comprises a first section, a second section and a third section. The first section affixes the strap to the shin guard and comprises a rear surface for facing the shin guard and a front surface that comprises a front affixing portion. The second section extends from the first section and comprises a rear surface. The third section extends from the second section and comprises a rear surface that has a rear affixing portion. In use, the rear surface of the second section faces a back portion of the wearer's leg and the third section at least partially overlaps the first section such that the user can engage the rear affixing portion with the front affixing portion for securing the leg pad to the leg.

13 Claims, 6 Drawing Sheets

LEG PAD WITH A STRAP

FIELD OF THE INVENTION

The present invention relates to a leg pad comprising a strap for securing the leg pad to a wearer's leg.

BACKGROUND OF THE INVENTION

Leg pads having straps for securing the leg pad to the wearer's leg are known in the art. Generally speaking, the leg pads are secured to the wearer's leg using two straps that are positioned slightly below the wearer's knee, and slightly above the wearer's ankle, respectively.

In one example of a prior art strap for securing a leg pad to a wearer's leg, the strap comprises a first end, a central region and a second end. The first end is attached at one side of the leg pad, the central region faces the back of the wearer's leg and the second end of the strap is passed through a slot in the opposing side of the leg pad and is then folded back such that it overlaps the central region of the strap. The second end of the strap is affixed to the central portion of the strap via VELCRO sections.

In another example of a prior art strap for securing a leg pad to a wearer's leg, the strap comprises a first end that is attached at one side of the leg pad, a central region that faces the back of the wearer's leg, and a second end that comprises a hook for securing the strap onto a ring affixed to the other side of the leg pad.

There is a need in the industry for a leg pad having a strap that alleviates, at least in part, the deficiencies associated with the prior art straps.

SUMMARY OF THE INVENTION

As embodied and broadly described herein, the invention provides a leg pad comprising a strap and a shin guard extending along a wearer's shin and wrapping partially around a wearer's leg. The strap comprises first, second and third sections. The first section is affixed to the shin guard and comprises a rear surface facing the shin guard and a front surface comprising a front affixing portion. The second section extends from the first section and comprises a rear surface. The third section extends from the second section and comprises a rear surface having a rear affixing portion. In use, the rear surface of the second section faces a back portion of the wearer's leg and the third section at least partially overlaps the first section such that the wearer can engage the rear affixing portion of the third section with the front affixing portion of the first section for securing the leg pad to the wearer's leg.

BRIEF DESCRIPTION OF THE DRAWINGS

A detailed description of embodiments of the present invention is provided hereinbelow with reference to the following drawings, in which.

Figure 1:
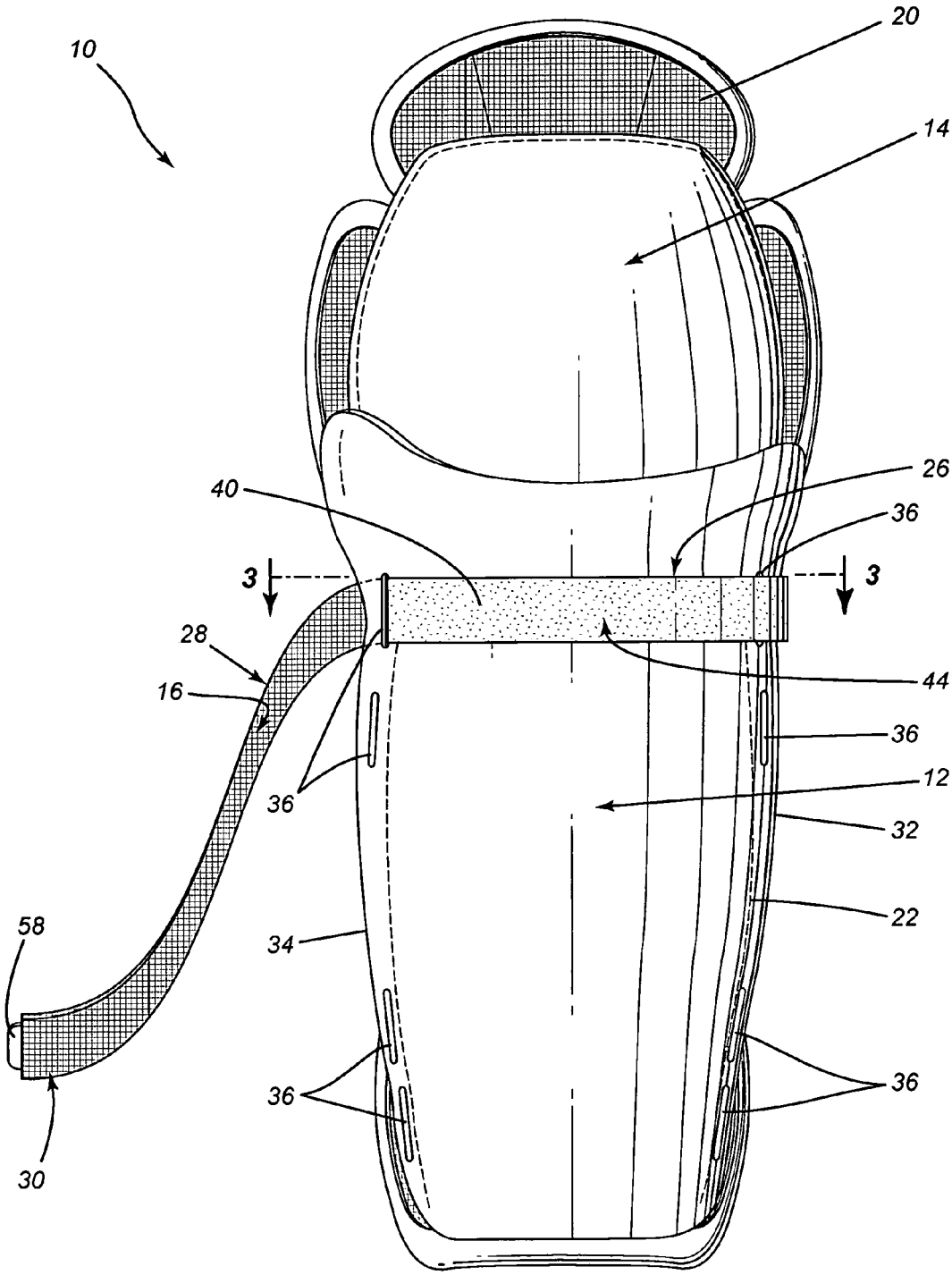
FIG. 1 shows a front elevation view of a leg pad constructed in accordance with a first embodiment of the present invention.

In the drawings, embodiments of the invention are illustrated by way of example. It is to be expressly understood that the description and drawings are only for the purposes of illustration and as an aid to understanding, and are not intended to be a definition of the limits of the invention.

DETAILED DESCRIPTION OF THE EMBODIMENTS

To facilitate the description, any reference numeral designating an element in one figure will designate the same element if used in any other figures. In describing the embodiments, specific terminology is resorted to for the sake of clarity but the invention is not intended to be limited to the specific terms so selected, and it is understood that each specific term comprises all equivalents.

Shown in FIGS. 1 to 4 is a leg pad 10 constructed in accordance with a first embodiment of the present invention. The leg pad 10 is adapted to be worn on a wearer's leg in order to protect the wearer during sporting games, such as hockey. The leg pad 10 comprises a shin guard 12, a knee guard 14 and a strap 16. The shin guard 12 extends along the wearer's shin and wraps partially around the wearer's lower leg, and the knee guard 14 covers a substantial portion of the front of the wearer's knee. Although for the purposes of the present invention the leg pad 10 will be described as having a knee guard 14, it should be understood that a leg pad 10 that comprises only a shin guard 12 is also included within the scope of the present invention.

The shin guard 12 and the knee guard 14 may be made of a rigid material, such as plastic, and may be attached to a padding liner 20. The padding liner 20 also extends along the wearer's shin and wraps partially around the wearer's lower leg. In the embodiment shown in FIG. 1 to 6, the padding liner 20 extends past the side edges of the shin guard 12, and extends above the top edge of the knee guard 14. The shin guard 12 and the knee guard 14 are attached to the padding liner 20 via stitching 22.

The padding liner 20 can be made of any suitable material or composition or materials that provide the degree of cushioning and protection that is desired. The padding liner 20 may be formed from foam material covered by layers of woven synthetic yarn, such as closed cell foam of ethylene vinyl acetate covered by a mesh outer layer of a woven synthetic material such as polyester.

Figure 3:
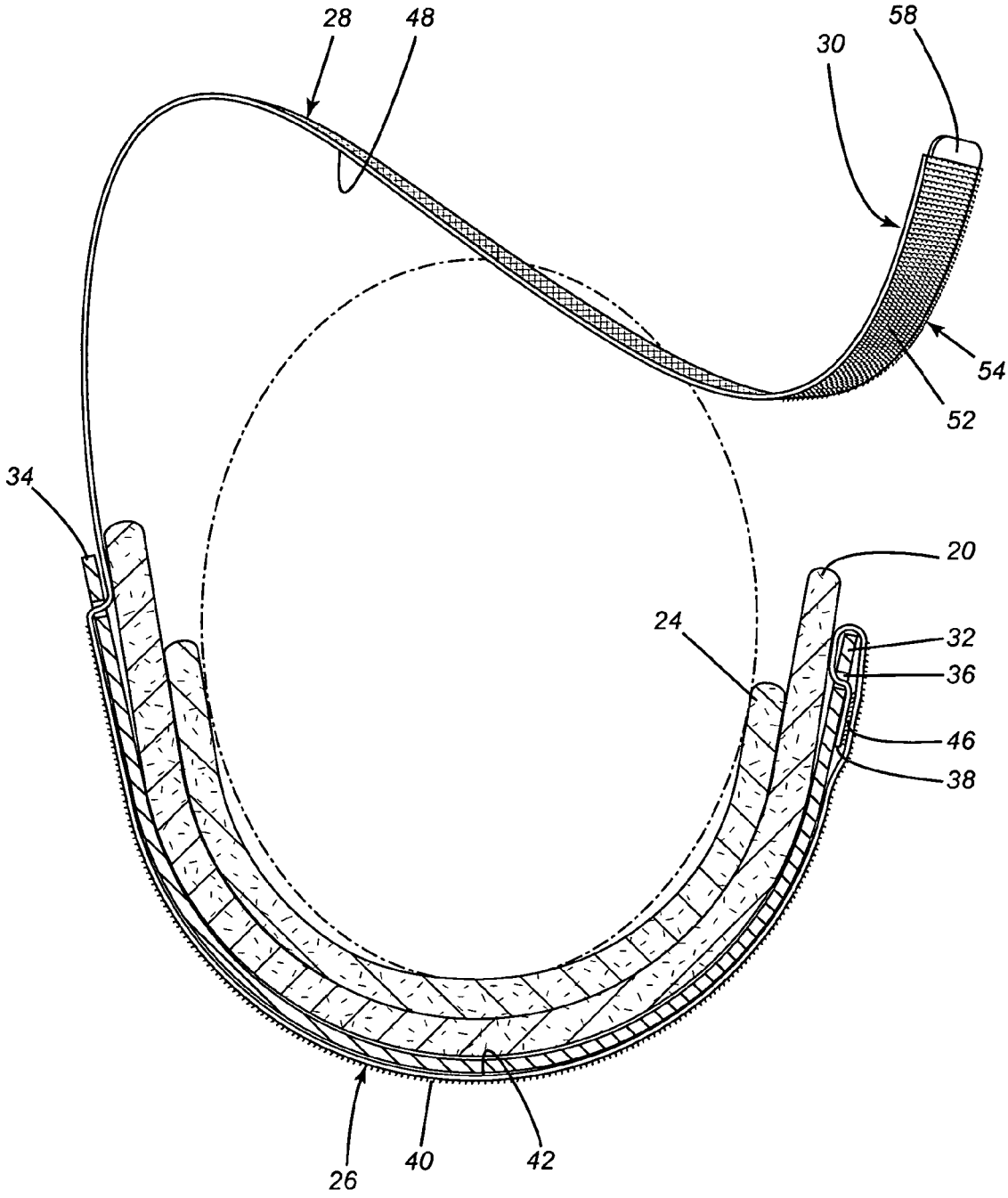
FIG. 3 shows a cross sectional view of the leg pad of FIG. 1 taken along line 3—3, wherein the leg pad is shown in an unfastened position against a wearer's leg.
Figure 4:
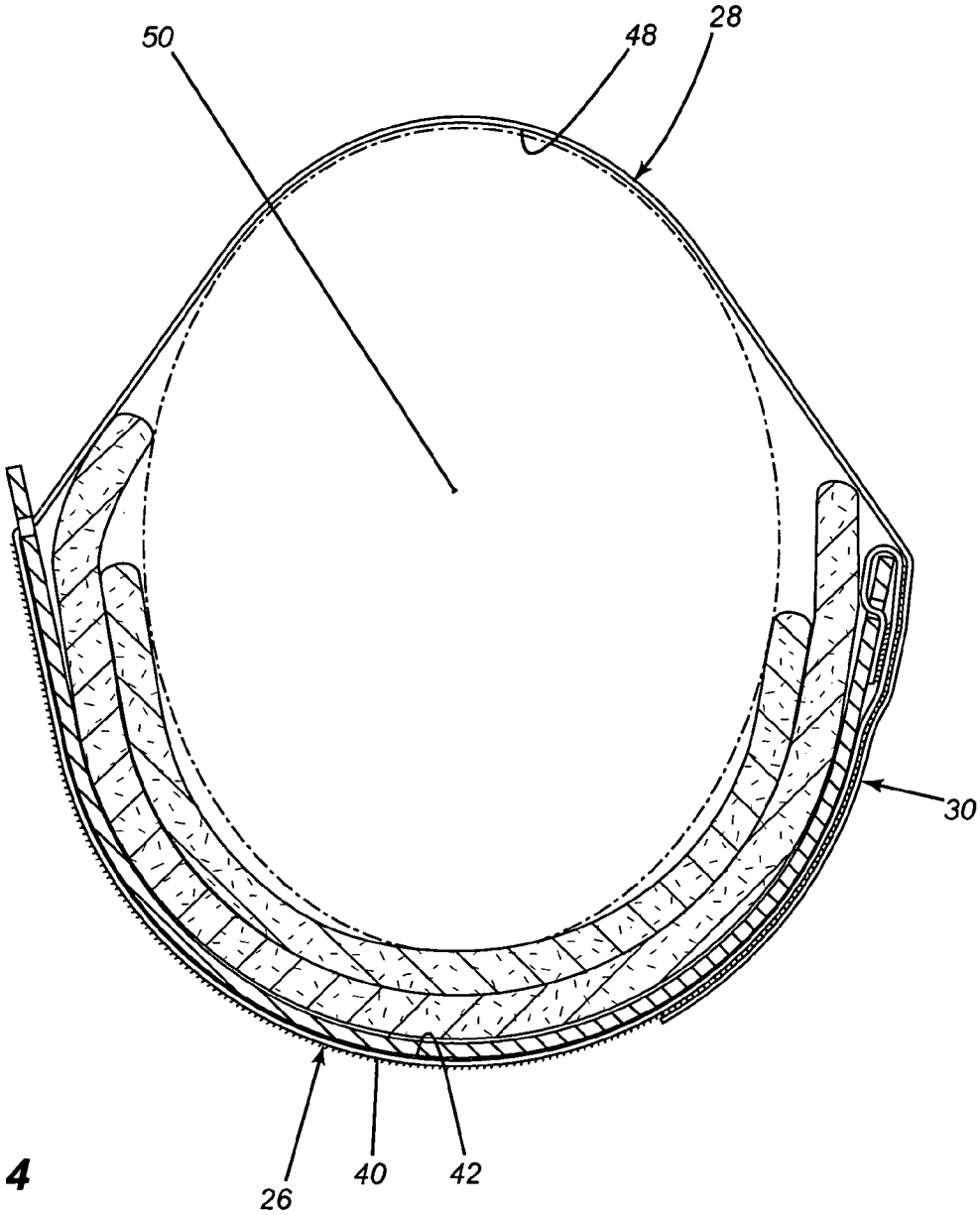
FIG. 4 shows cross sectional view of the leg pad of FIG. 1 shown in a fastened position against a wearer's leg.

As shown in FIGS. 3 and 4, affixed to the inner surface of the padding liner 20 is an inner padding 24. The inner padding 24 does not extend as far up the wearer's leg, and does not wrap as far around the wearer's lower leg, as the padding liner 20. The inner padding 24 may absorb some of the shock imparted to the leg pad 10 during use, and may conform to the shape of the wearer's leg in order to provide a more comfortable fit for the wearer.

The inner padding 24 may be removably connected to the padding liner 20 via VELCRO sections, such that it can be removed in order to be cleaned or replaced. In an alternative embodiment, the inner padding 24 can be permanently affixed to the padding liner 20 via stitching.

The inner padding 24 may also be formed from a foam material covered by layers of woven synthetic yarn. In addition, the foam material for the inner padding 24 can be thicker than the foam material for the padding liner 20, so as to provide more shock absorbency than the padding liner 20.

As mentioned above, the leg pad 10 comprises a strap 16 that for securing the leg pad 10 to the wearer's leg. As shown in FIG. 1, the strap comprises a first section 26, a second section 28 and a third section 30. Each of these sections will be described in more detail below.

Referring to FIGS. 1 to 4, the first section 26 of the strap 16 spans from the right side 32 of the shin guard 12 to the left side 34 of the shin guard, and comprises a front surface 40 and a rear surface 42. The rear surface 42 of the strap 16 faces the shin guard 12, and the front surface 40 of the strap 16 comprises a front affixing portion 44. The front affixing portion 44 spans the entire length of the first section 26, from the right side 32 of the shin guard 12 to the left side 34 of the shin guard 12 and consists of loops that are adapted for being engaged by hooks located on another portion of the strap 16. It should be understood that in an alternative embodiment, the front affixing portion 44 can span only a portion of the first section 26 of the strap 16, and can comprise other affixing means known in the art, such as poppers or buttons.

Figure 2:
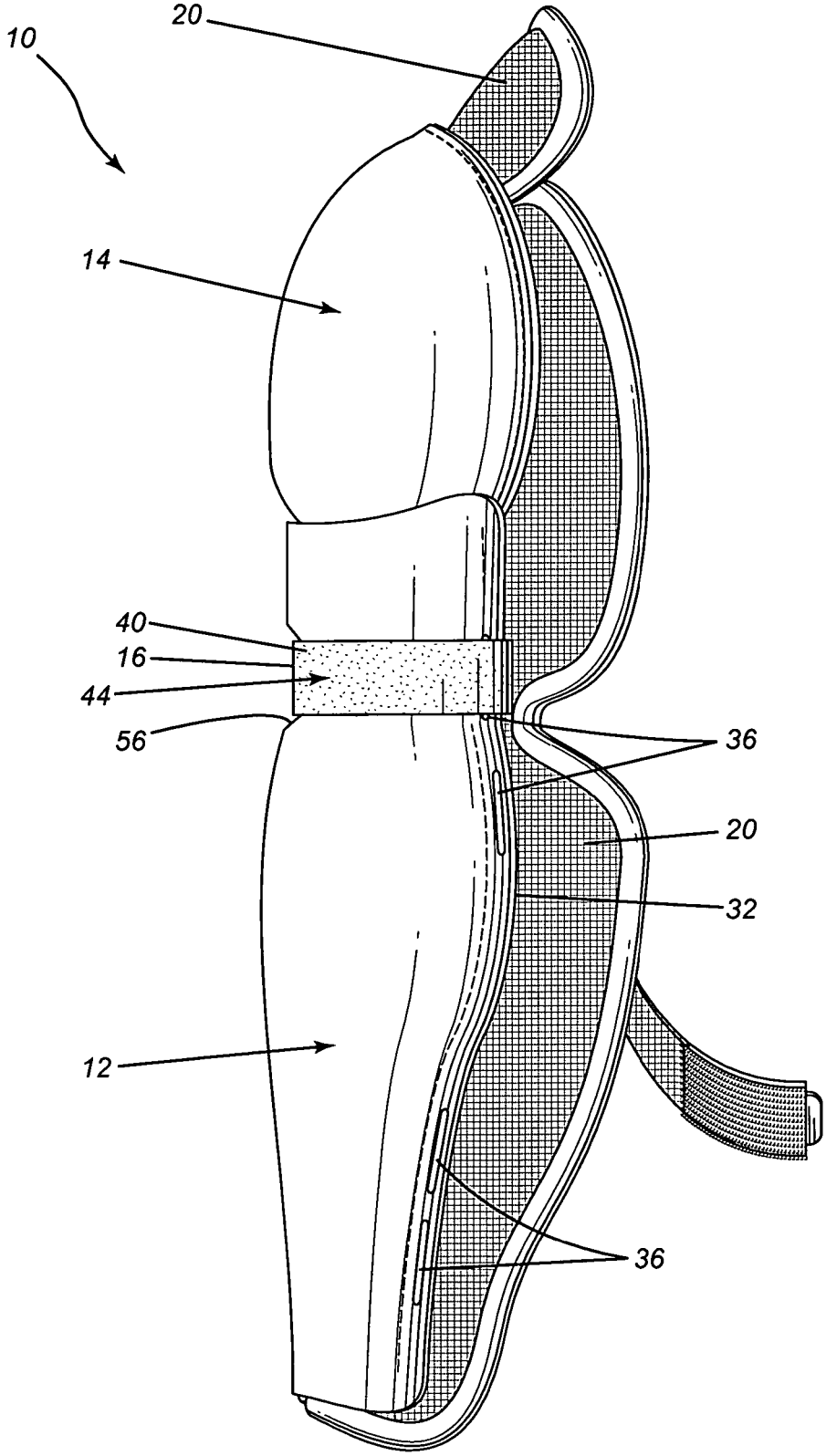
FIG. 2 shows a side elevation view of the leg pad shown in FIG. 1.

The first section 26 of the strap 16 is adapted to affix the strap 16 to the shin guard 12. As shown in FIGS. 1 to 2, the shin guard 12 may comprise two pairs of apertures 36 in the upper position and two pairs of apertures 36 in the lower position. Each pair of apertures 36 comprises an aperture 36 located proximate to the right side 32 of the shin guard 12, and an aperture 36 located proximate to the left side 34 of the shin guard 12. Although only one strap 16 is shown in FIGS. 1 to 4, it is possible that the leg pad 10 is secured to the wearer's leg using two straps 16, namely, a first strap 16 in the upper position and a second strap 16 in the lower position. As such, in order to affix the first strap 16 in the upper position, the wearer can choose to use either one of the two pairs of apertures 36 in the upper position, and in order to affix the second strap 16 in the lower position, the wearer can choose to use either one of the two pairs of apertures 36 in the lower position. In this manner, the wearer is able to adjust the position of the straps 16 in order to obtain a comfortable fit.

In use, the first section 26 of the strap 16 is affixed to the shin guard 12 by wrapping the first end portion 38 of the strap 16 (shown in FIG. 3) around one side of the shin guard 12 and then passing it through an aperture 36 located proximate to the side of the shin guard 12 that the first end portion 38 was wrapped around. In the case of the strap 16 shown in FIGS. 1 and 2, the first end portion 38 of the strap 16 passes through the uppermost aperture 36 located proximate to the right side 32 of the shin guard 12. It should be understood, however, that a wearer could have passed the first end portion 38 of the strap 16 through an aperture 36 located on either the right side 32 or left side 34 of the shin guard 12.

Figure 5:
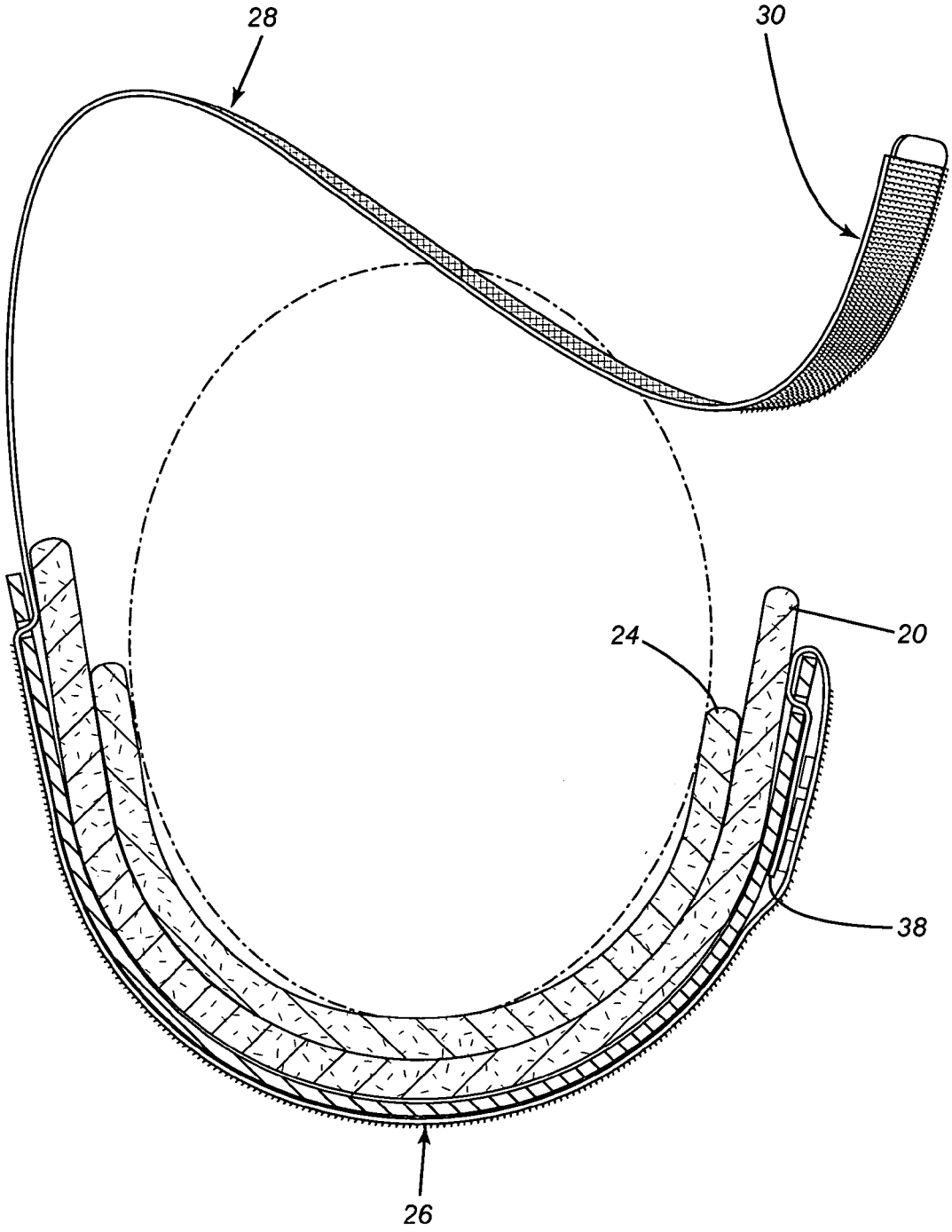
FIG. 5 shows a cross-sectional view of a leg pad constructed in accordance with a second embodiment of the present invention.
Figure 6:
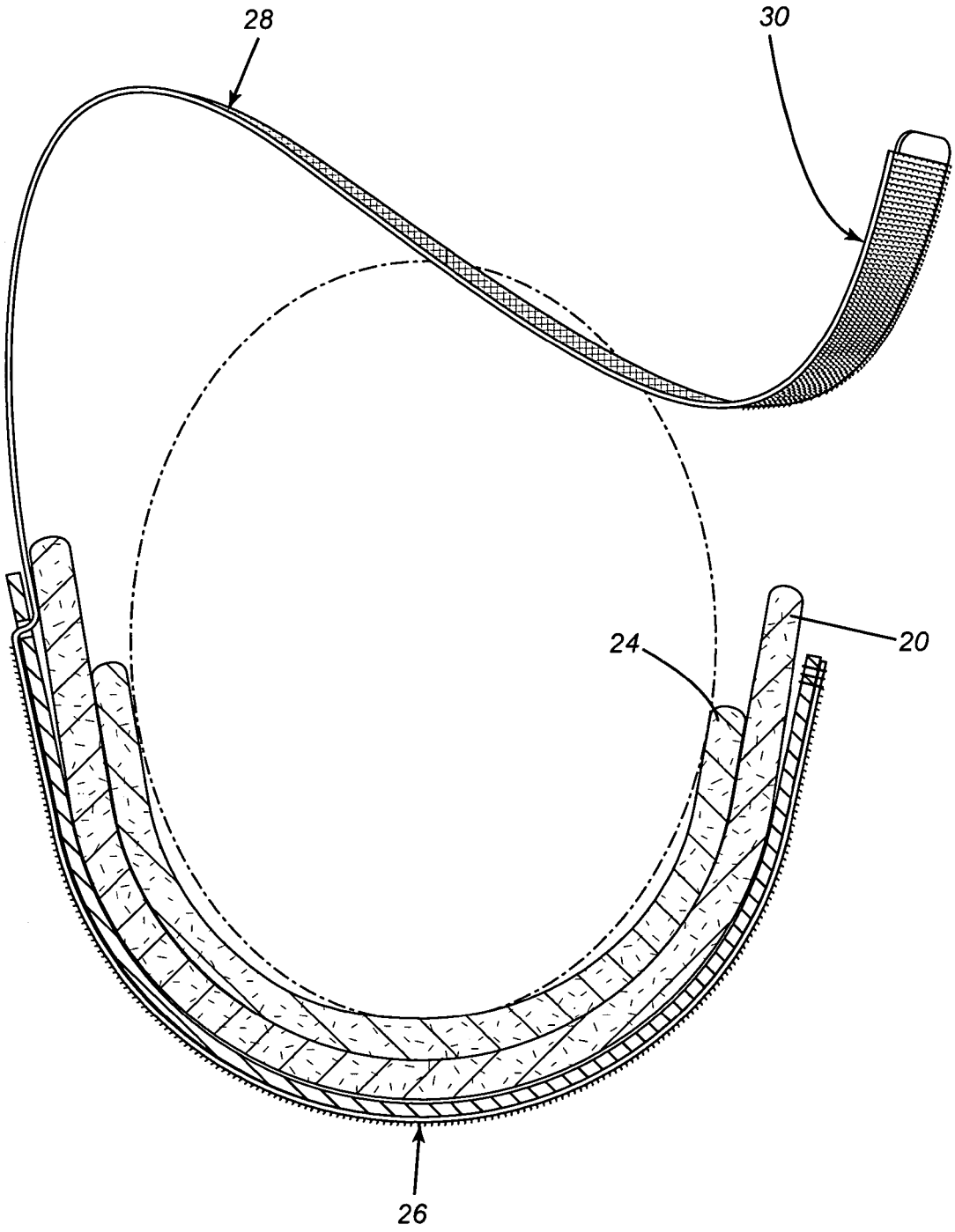
FIG. 6 shows a cross-sectional view of a leg pad constructed in accordance with a third embodiment of the present invention.

Once the first end portion 38 of the strap has been passed through an aperture 36, the back surface 46 of the first end portion 38 is affixed to at least a portion of the rear surface 42 of the remainder of the first section 26. The back surface 46 of the first end portion 38 is affixed to the rear surface 42 of the remainder of the first section 26 via loops and hooks sections (VELCRO sections). As shown in FIG. 3, it is the back surface 46 that comprises the loops section, and the rear surface 38 that comprises the hooks section, however, this can be reversed without departing from the spirit of the invention. In this manner, the strap 16 is removably affixed to the shin guard 12. In a second embodiment, the back surface 46 can be removably affixed to the rear surface 42 in another manner known in the art, such as by buttons, or poppers, as shown in FIG. 5.

Because the back surface 46 of the first end portion 38 is releasably affixed to the rear surface 42 of the remainder of the first section 26, the wearer can adjust the length of the strap 16. In other words, the farther the first end portion 38 of the strap 16 passes through an aperture 36, the shorter the remaining portion of the strap 16 becomes.

Once the first end portion 38 has been affixed to an aperture 36 located on one side of the shin guard 12, a portion of the remainder of the strap 16 passes through the aperture 36 located on the other side of the shin guard 12. In the embodiment shown in FIGS. 1 and 2, the strap 16 passes through the aperture 36 located on the left side 34 of the shin guard 12. As such, the fact that there is a pair of apertures, with an aperture 36 located on each of the right side 32 and left side 34 of the shin guard 12, helps to maintain the first section 26 of the strap 16 in place on the shin guard 12. It should be understood that a shin guard 12 having an aperture or apertures 36 on only one side of the shin guard 12 is also within the scope of the present invention.

In another embodiment, the shin guard 12 may not comprise apertures 36 at all, and instead the first section 26 of the strap 16 may be permanently affixed to the shin guard 12. For example, the first end portion 38 of the strap can be permanently affixed to the shin guard 12 via stitching 21, as shown in the second embodiment illustrated in FIG. 6.

In the first embodiment shown in FIG. 2, the shin guard 12 comprises a groove 56 for receiving the first section 26 of the strap 16. The groove 56 helps to maintain the strap 16 in position on the shin guard 12. Although not shown in the figures, it is within the scope of the invention for the shin guard 12 to comprise a groove in the lower position, as well, in order to help to maintain a strap 16 affixed to one of the lower two pairs of apertures 36 in place.

The second section 28 of the strap 16 extends from the first section 26 of the strap 16, and comprises a rear surface 48. The second section 28 is adapted for wrapping around the back of the wearer's leg 50, which is shown in dotted lines in FIGS. 4 and 5, such that, in use, its rear surface 48 faces the back of the wearer's leg. The second section 26 of the strap 16 may be made from an elastic material that is able to stretch as the wearer wraps it around his or her leg. The second section 28 may also be made from the same material as the first section 26 and the third section 30.

The third section 30 of the strap 16 extends from the second section 28, and comprises a rear surface 52 that has a rear affixing portion 54. In use, once the second section 28 has been wrapped around the back of the wearer's leg 50, the third section 30 at least partially overlaps the first section 28 as shown in FIG. 4.

Referring to FIGS. 3 and 4, the rear affixing portion 54 comprises a hooks section (VELCRO section) for engaging the loops section (VELCRO section) of the front affixing portion 44. In an alternative embodiment, the rear affixing portion 54 comprises the loops section, and the front affixing portion 44 comprises the hooks section. In yet another alternative embodiment, the rear affixing portion 54 and the front affixing portion 44 are affixed together using other attachment means known in the art, such as buttons, poppers, etc.

The third section 30 further comprises a projecting tab 58 that does not form part of the rear affixing portion 54, and therefore does not affix to the first section 26. As such, when the wearer desires to remove the leg pad 10 from his or her leg, the wearer is able to easily grasp the projecting tab 58 in order to remove the third section 30 of the strap 16 from the first section 26.

In use, the first step in securing the leg pad 10 to the wearer's leg, is to affix the strap 16 to the shin guard 12, in one of the manners described above. It should be understood that the strap 16 does not need to be affixed to the shin guard 12 each time the wearer puts the leg pad 10 on. In other words, once the strap 16 has been affixed to the shin guard 12, the strap 16 can remain affixed to the shin guard 16 until a user desires to replace the strap 16, or adjust its length. It should be understood that in the case where the strap 16 is permanently affixed to the shin guard 12, this first step is not necessary.

Once the strap 16 has been affixed to the shin guard 12, the second section 28 of the strap 16 is wrapped around the back of the wearer's leg. Then, the third section 30 of the strap is wrapped further around the leg pad 10, thereby at least partially overlapping the first section 26, such that the wearer can engage the rear affixing portion 54 with the front affixing portion 44 in order to secure the leg pad 10 to the wearer's leg.

The above description of embodiments should not be interpreted in a limiting manner since other variations, modifications and refinements are possible within the spirit and scope of the present invention. The scope of the invention is defined in the appended claims and their equivalents.

The invention claimed is:

1. A leg pad for a hockey player having a leg with a knee and a shin, said leg pad comprising:

(a) a knee guard for covering the knee of the hockey player;

(b) a shin guard extending along the shin of the hockey player and wrapping partially around the leg of the hockey player; and (c) a strap comprising:

(i) a first section having a first end portion releasably affixed to said shin guard, said first section comprising a rear surface facing said shin guard and a front surface comprising a front affixing portion;

(ii) a second section extending from said first section, said second section comprising a rear surface; and (iii) a third section extending from said second section, said third section comprising a rear surface having a rear affixing portion, wherein, in use, said rear surface of said second section faces a back portion of the leg, and said third section at least partially overlaps said first section such that the hockey player can engage said rear affixing portion of said third section with said front affixing portion of said first section for securing said leg pad to the leg.

2. A leg pad as defined in claim 1, wherein said shin guard comprises a left side and a right side, at least one of said left side and said right side comprising an aperture for receiving said strap.

3. A leg pad as defined in claim 2, wherein said first end portion wraps around an edge of said shin guard; passes through said aperture; and is releasably affixed to a remaining portion of said first section.

4. A leg pad as defined in claim 3, wherein said first end portion comprises a back surface, said back surface being adapted for affixing to said rear surface of said remaining portion of said first section.

5. A leg pad as defined in claim 4, wherein said back surface comprises one of hooks and loops and wherein said rear surface comprises the other one of hooks and loops.

6. A leg pad as defined in claim 3, wherein said third section comprises a projecting tab for facilitating removal of said third section from said first section.

7. A leg pad as defined in claim 1, wherein at least a portion of said second section comprises elastic.

8. A leg pad as defined in claim 1, wherein said shin guard and said knee guard are made of a rigid material.

9. A leg pad as defined in claim 8, wherein said rigid material is plastic.

10. A leg pad as defined in claim 9, wherein said shin guard comprises a groove for receiving said strap.

11. A leg pad as defined in claim 10, wherein said shin guard comprises a padding liner and an inner padding.

12. A leg pad as defined in claim 11, wherein said padding liner and said inner padding are made of foam material.

13. A leg pad for a hockey player having a leg with a knee and a shin, said leg pad comprising:

(a) a knee guard for coveting the knee of the hockey player, said knee guard being made of plastic;

(b) a shin guard extending along the shin of the hockey player and wrapping partially around the leg of the hockey player, said shin guard being made of plastic and comprising a right aperture proximate to a right side of said shin guard and a left aperture proximate to a left side of said shin guard; and (c) a strap comprising:

i) a first section comprising a rear surface facing said shin guard and a front surface comprising a front affixing portion;

ii) a second section extending from said first section, said second section comprising a rear surface; and iii) a third section extending from said second section, said third section comprising a rear surface having a rear affixing portion, wherein, in use, said rear surface of said second section faces a back portion of the leg, and said third section at least partially overlaps said first section such that the hockey player can engage said rear affixing portion of said third section with said front affixing portion of said first section for securing said leg pad to the leg, and wherein said first end portion wraps around an edge of said shin guard, passes through one of said right and left apertures and is releasably affixed to a remaining portion of said first section.

* * * * *